US007931482B2

(12) United States Patent
Liao

(10) Patent No.: US 7,931,482 B2
(45) Date of Patent: Apr. 26, 2011

(54) SAFETY SOCKET STRUCTURE

(76) Inventor: Sheng-Hsin Liao, Shulin (TW)

( * ) Notice: Subject to any disclaimer, the term of this patent is extended or adjusted under 35 U.S.C. 154(b) by 195 days.

(21) Appl. No.: 12/406,714

(22) Filed: Mar. 18, 2009

(65) Prior Publication Data

US 2010/0130064 A1 May 27, 2010

(30) Foreign Application Priority Data

Nov. 21, 2008 (TW) ..... 97145054 A

(51) Int. Cl.
*H01R 13/44* (2006.01)

(52) U.S. Cl. ..... 439/137

(58) Field of Classification Search ..... 439/135, 439/137, 138, 139, 140, 143
See application file for complete search history.

(56) References Cited

U.S. PATENT DOCUMENTS

| | | | | |
|---|---|---|---|---|
| 3,352,982 | A * | 11/1967 | Walther | 200/51.07 |
| 4,780,089 | A * | 10/1988 | Wernick | 439/138 |
| 7,452,221 | B1 * | 11/2008 | Oddsen et al. | 439/137 |
| 2010/0130064 | A1 * | 5/2010 | Liao | 439/638 |

FOREIGN PATENT DOCUMENTS

| | | |
|---|---|---|
| TW | M335066 | 6/2008 |

* cited by examiner

*Primary Examiner* — James Harvey
(74) *Attorney, Agent, or Firm* — Muncy, Geissler, Olds & Lowe, PLLC

(57) ABSTRACT

A safety socket structure includes a casing, two control pieces, and two contact pieces. The casing is provided with two insertion holes and two through-holes. The interior of the casing is formed with connecting positions corresponding to the insertion holes. The two control pieces are liftably provided in the casing and protrude through the two through-holes to the outside of the casing. The two contact pieces are provided in the casing and abut the two contact pieces, thereby controlling the two contact pieces to extend into the connecting positions selectively. Via this arrangement, a safety socket structure that has a lower cost and is not liable to suffer damage can be achieved.

20 Claims, 15 Drawing Sheets

SAFETY SOCKET STRUCTURE

BACKGROUND OF THE INVENTION

1. Field of the Invention

The present invention relates to a socket structure, and in particular to a safety socket structure, thereby preventing the risk of getting an electric shock upon the insertion of a metallic rod and increasing the safety in operation.

2. Description of Related Art

Conventional sockets are used to electrically connect with the power supplies of various electrical appliances. As the number of electrical appliances increases, the sockets are used more frequently. Accordingly, the manufacturers continue to improve the structure of socket in order to perfect its function. Most of the conventional sockets are not provided with any means for protecting the safety of a user. Thus, even when a plug is not inserted into the socket, the socket is still live, so that a child may get an electric shock when he/she inserts a metallic rod.

Currently, many kinds of safety sockets are available in the market for preventing children from getting an electric shock when they insert a metallic rod. Taiwan Patent Publication No. M335066 discloses an improved socket structure, which comprises a bottom casing, an upper casing, and a power supply control unit. The bottom casing has two insertion pieces. Power supply conductive pieces are provided at positions corresponding to the two insertion pieces. When a plug is not inserted into the socket, the power supply conductive pieces and the insertion pieces are not brought into electrical contact with each other, so that the insertion pieces form a broken circuit. The upper casing is provided with two power supply insertion holes and through-holes. The power control unit is provided with a control rod and a control block. A protrusion of the control rod protrudes outside the through-hole of the upper casing. The control block is provided between the two power supply conductive pieces. When the plug is inserted into the power supply insertion holes of the upper casing, the protrusion of the control rod and the control block can be pressed, so that the control block pushes the two power supply conductive pieces to contact the two insertion pieces, thereby generating an electric connection between the power supply conductive pieces and the insertion pieces. Thus, when the plug is not inserted into the power supply insertion holes of the upper casing, the two power supply conductive pieces are not brought into contact with the two insertion pieces, so that the power supply conductive pieces will not be electrically connected to the insertion pieces. In this way, children can be protected from getting an electric shock when they insert a metallic rod.

However, the existing safety sockets are very complicated in design with a lot of components. As a result, it takes a lot of time and labor to assemble such a safety socket, which increases the cost. On the other hand, due to the numerous components, the safety socket is liable to suffer damage, which causes inconvenience in use.

Consequently, because of the above limitation resulting from the technical design of prior art, the inventor strives via real world experience and academic research to develop the present invention, which can effectively improve the limitations described above.

SUMMARY OF THE INVENTION

The object of the present invention is to provide a safety socket structure, whereby the cost thereof can be reduced. Further, the safety socket is not liable to suffer damage, so that it can be used easily.

In order to achieve the above objects, the present invention provides a safety socket structure, which comprises: a casing provided with two insertion holes and two through-holes, the interior of the casing being formed with connecting positions corresponding to the insertion holes, the two control pieces being liftably provided in the casing and respectively protruding through the two through-holes to the outside of the casing; and two contact pieces provided in the casing, the two contact pieces abutting the two contact pieces with the two contact pieces extending into the connection positions selectively.

The present invention has advantageous features as follows. Since the safety socket merely comprises the casing, the control pieces, and the contact pieces, it is simple in structure with fewer components. Thus, it is easier to assemble the safety socket and the cost can be reduced efficiently. Further, the safety socket of the present invention is not liable to suffer damage, so that it can be used easily.

In order to further understand the characteristics and technical contents of the present invention, a detailed description relating thereto will be made with reference to the accompanying drawings. However, the drawings are illustrative only, but not used to limit the scope of the present invention.

DETAILED DESCRIPTION OF THE PREFERRED EMBODIMENTS

Figure 1:
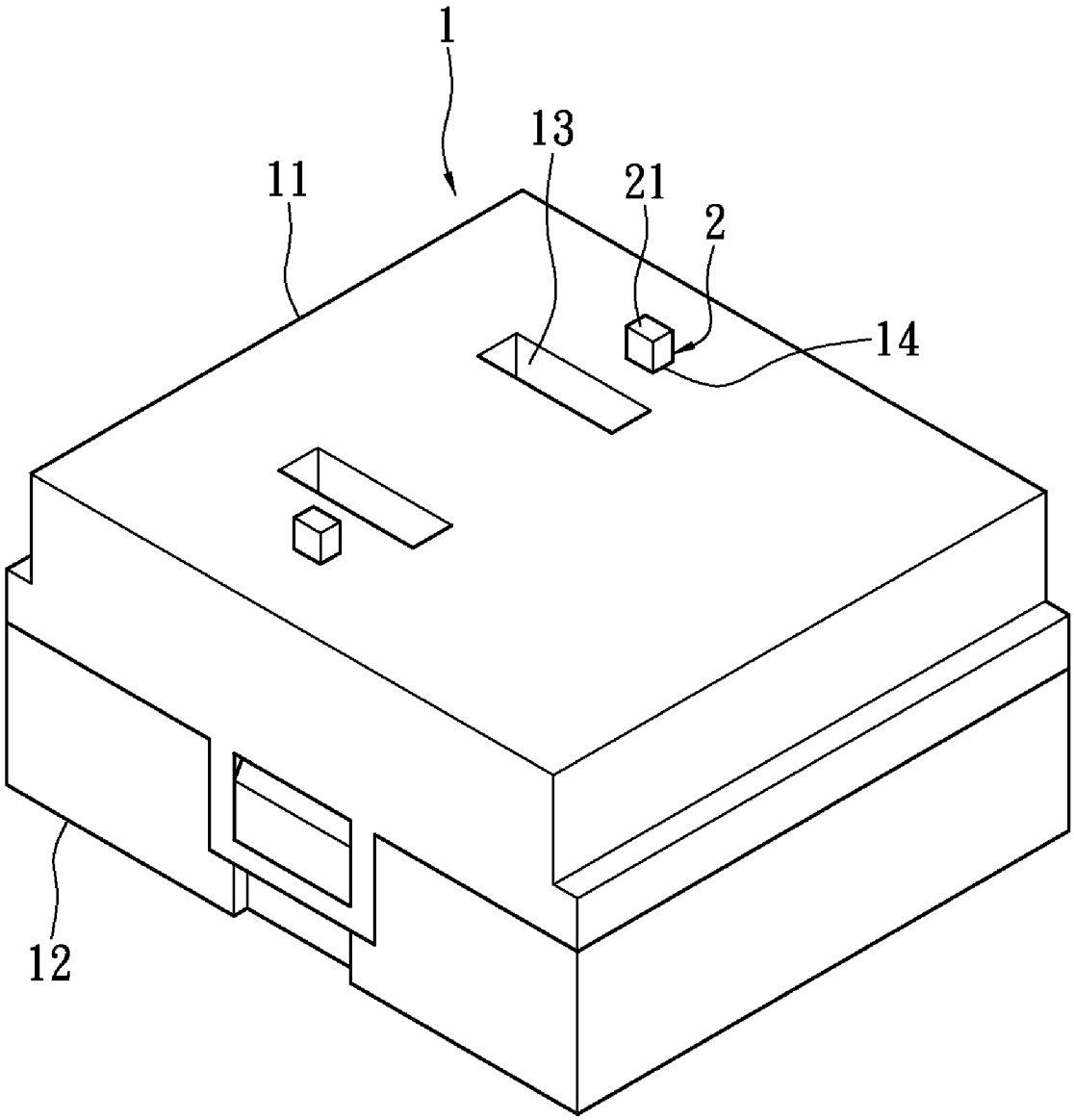
FIG. 1 is a perspective view showing a safety socket structure according to the first embodiment of the present invention.
Figure 2:
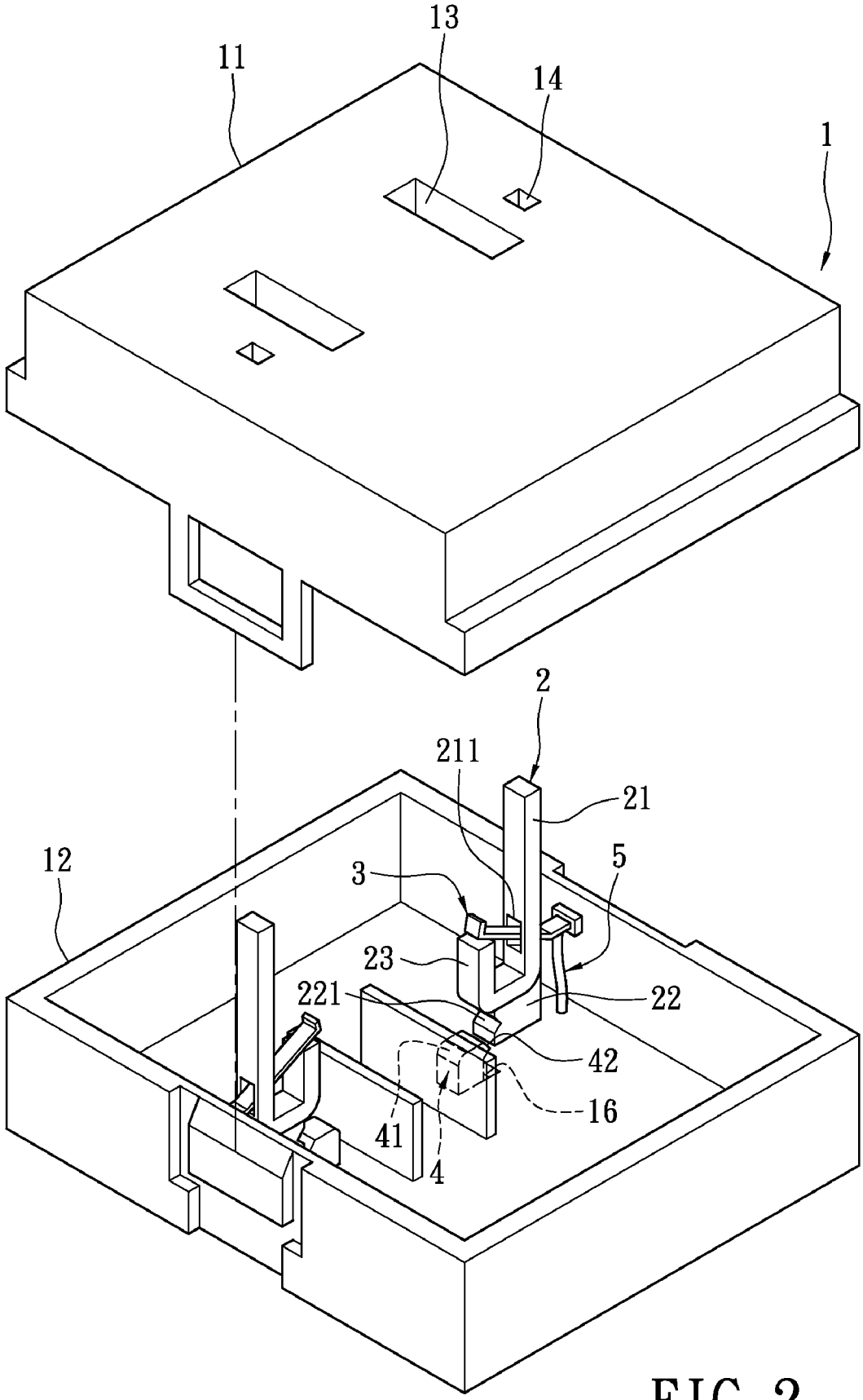
FIG. 2 is an exploded perspective view showing the safety socket structure according to the first embodiment of the present invention.

Please refer to FIGS. 1 to 4. The present invention provides a safety socket structure, which comprises a casing 1, two control pieces 2, two contact pieces 3, and two sliding blocks 4. The casing 1 comprises an upper shelf 11 and a lower shelf 12. The upper shelf 11 is provided above the lower shelf 12. The upper shelf 11 and the lower shelf 12 are connected together by means of wedging, screw elements, or supersonic welding, thereby forming a whole casing 1. The top of the casing 1 is provided with at least two insertion holes 13. The dimension of the insertion hole 13 is not limited to a specific standard, and it can be varied according to practical demands.

In the present embodiment, two insertion holes 13 are provided. Alternatively, a plurality of insertion holes 13 may be provided; further, a plurality of control pieces 2, contact pieces 3, and sliding blocks 4 can be provided correspondingly. The interior of the casing 1 is formed with connecting positions 19 corresponding to the insertion holes 13. That is, the connecting positions 19 are located exactly below the insertion holes 13. The top of the casing 1 is further provided with through-holes 14 corresponding to the control pieces 2. In the present embodiment, two control pieces 2 and two corresponding through-holes 14 are provided. The two through-holes 14 are located outside the two insertion holes 13 with a suitable distance. However, the positions of the through-holes 14 can be changed suitably. Each insertion hole 13 can be provided with two clippers 15 extending from the inner wall of the casing 1. The two clippers 15 are provided on both sides of the insertion hole 13. The two clippers 15 are separated by a distance and formed by extending from the inner wall of the casing 1 with a suitable length, thereby clamping two pins 61 of a plug 1. In this way, the plug 6 can be inserted into the safety socket more firmly.

The two control pieces 2 are made of insulating materials such as plastics. The two control pieces 2 are liftably provided in the casing 1. Each control piece 2 has a rod 21 and an engaging body 22. The rod 21 is provided with a penetrating-hole 211 passing through two opposite surfaces of the rod 21. The penetrating-hole 211 can be used as an abutting portion. The engaging body 22 is formed by extending from the lower end of the rod 21. One side of the engaging body 22 is provided with a trough 221. The top of the engaging body 22 further extends to form a stopper 23 that can be located between (or outside) the contact piece 3 and the connecting position 19. The rod 21 of the control piece 2 is slidably fitted in the through-hole 14 of the casing 1, so that the control piece 2 can be displaced up and down. The upper end of the rod 21 of the control piece 2 protrudes through the through-hole 14 to the outside of the top of the casing 1.

The two contact pieces 3 are made of metallic materials with good electric conductivity. The two contact pieces 3 are provided in the casing 1. One end of each contact piece 3 forms a fixed end 31. The fixed end 31 is fixed to the casing 1, thereby forming a fulcrum. The two contact pieces 3 are connected with a power line 5 respectively for inputting power to the two contact pieces 3. The two contact pieces 3 pass through the penetrating-holes 211 of the corresponding control pieces 2. The other end of the contact piece 3 forms a contact end 32 that is a free end. The upper edge of the penetrating-hole 211 of the control piece 2 abuts the contact piece 3, so that the two contact pieces 3 can swing downwards. When the contact ends 32 of the two contact pieces 3 swing downwards, the contact ends 32 are located at the connecting positions 19 exactly below the insertion holes 13, thereby contacting the pins 61 of the plug 6.

The two sliding blocks 4 are provided in the casing 1. The two sliding blocks 4 are located inside the two locking bodies 22. The sliding block 4 is slidably fitted in a corresponding guiding groove 16 of the casing 1, so that the sliding block 4 can be slidably provided in the casing 1. The sliding block 4 can slide toward (or away from) the engaging body 22 of the control piece 2. One side of each sliding block 4 is formed with an abutting surface 41 that is a slope. Opposite to the abutting surface 41, the other side of each sliding block 4 is provided with a protrusion 42 corresponding to the trough 221. When the sliding block 4 slides toward the engaging body 22 of the control piece 2, the protrusion 42 of the sliding body 4 can be engaged with the trough 221 of the engaging body 22 of the control piece 2. Via the above arrangement, the safety socket structure of the present invention can be formed.

Figure 4:
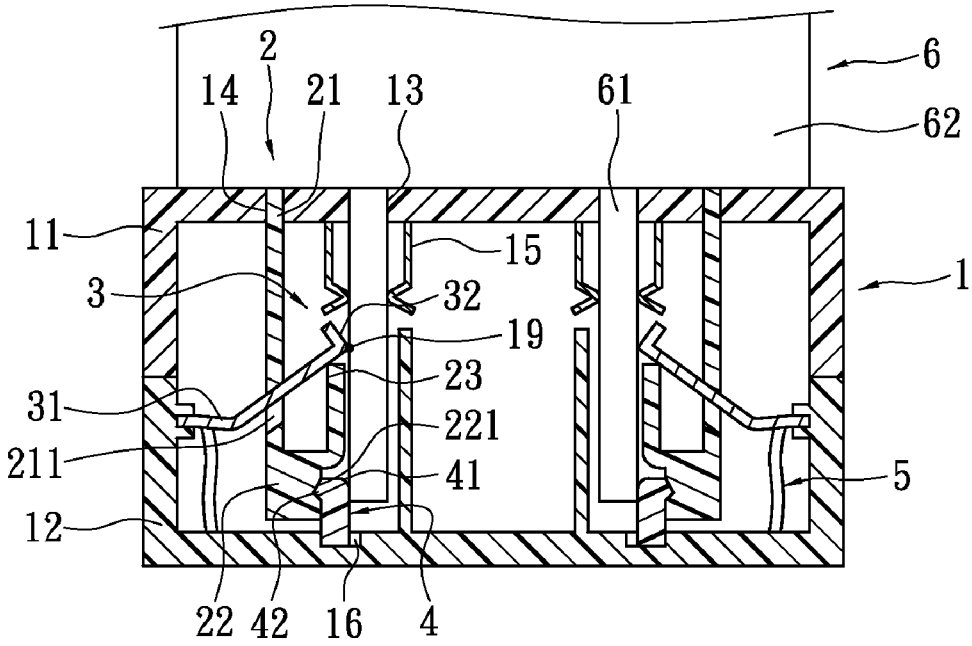
FIG. 4 is a schematic view showing the operating state of the safety socket structure according to the first embodiment of the present invention.

Please refer to FIG. 4. When the plug 6 is inserted in the safety socket of the present invention, the pins 61 of the plug 6 are inserted into the casing 1 through the two insertion holes 13 of the casing 1. The bottom of the body 62 of the plug 6 abuts the upper ends of the rods 21 of the two control pieces 2, thereby making the two control pieces 2 descend. With the upper edges of the penetrating-holes (which can be used as abutting portions) 211 of the two control pieces 2 abutting the two contact pieces 3, the contact ends 32 of the two contact pieces 3 swing downwards to be located in the connecting position 19, thereby contacting the pins 61 of the plug 6. In this way, the two contact pieces 3 are electrically connected to the pins 61 of the plug 6. At the same time, the lower ends of the two pins 61 of the plug 6 abut the abutting surfaces 41 of the two sliding blocks 4, so that the two sliding blocks 4 slide toward the engaging bodies 22 of the two control pieces 2. The protrusions 42 of the two sliding blocks 4 can be engaged with the troughs 221 of the engaging bodies 22 of the two control pieces 2, thereby engaging the two control pieces 2.

Figure 3:
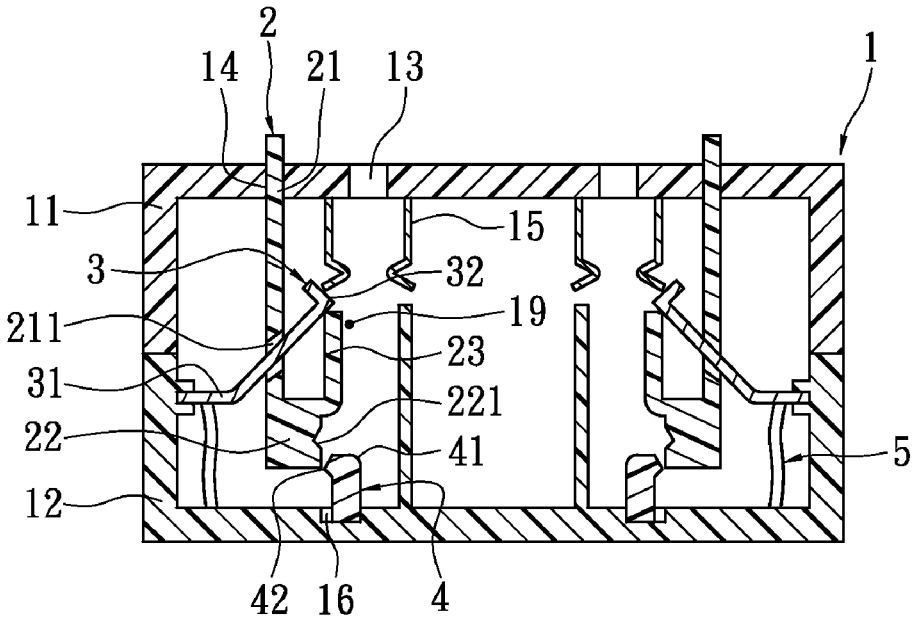
FIG. 3 is a cross-sectional view showing the safety socket structure according to the first embodiment of the present invention.

When the plug 6 is not inserted into the safety socket of the present invention as shown in FIG. 3, the upper ends of the two control pieces 2 are not abutted to move downwards by the bottom of the body 62 of the plug 6, so that the contact ends 32 of the two contact pieces 3 swing upwards and are not located in the connecting position 19. In this way, children can be protected from getting an electric shock.

The safety socket of the present invention merely comprises a casing 1, control pieces 2, contact pieces 3, and sliding blocks 4. It is simple in structure with fewer components. Thus, it is easy to assemble this safety socket, so that the cost can be reduced. Further, the safety socket of the present invention is not liable to suffer damage, so that it can be used more conveniently.

According to the present invention, the protrusion 42 of the sliding block 4 is engaged with the trough 221 of the engaging body 22 of the control piece 2, thereby fixing the two control pieces 2 and guaranteeing a firm contact between the two contact pieces 3 and the two pins 61 of the plug 6.

The control piece 2 extends to form the stopper 23. When the contact piece 3 swings downwards, the stopper 23 is used to stop the contact piece 3, thereby preventing the contact pieces 3 from swinging downwards excessively to generate undesired deformation. The stopper 23 also prevents a child from contacting the contact piece 3 when he/she inserts a metallic rod.

Figure 5:
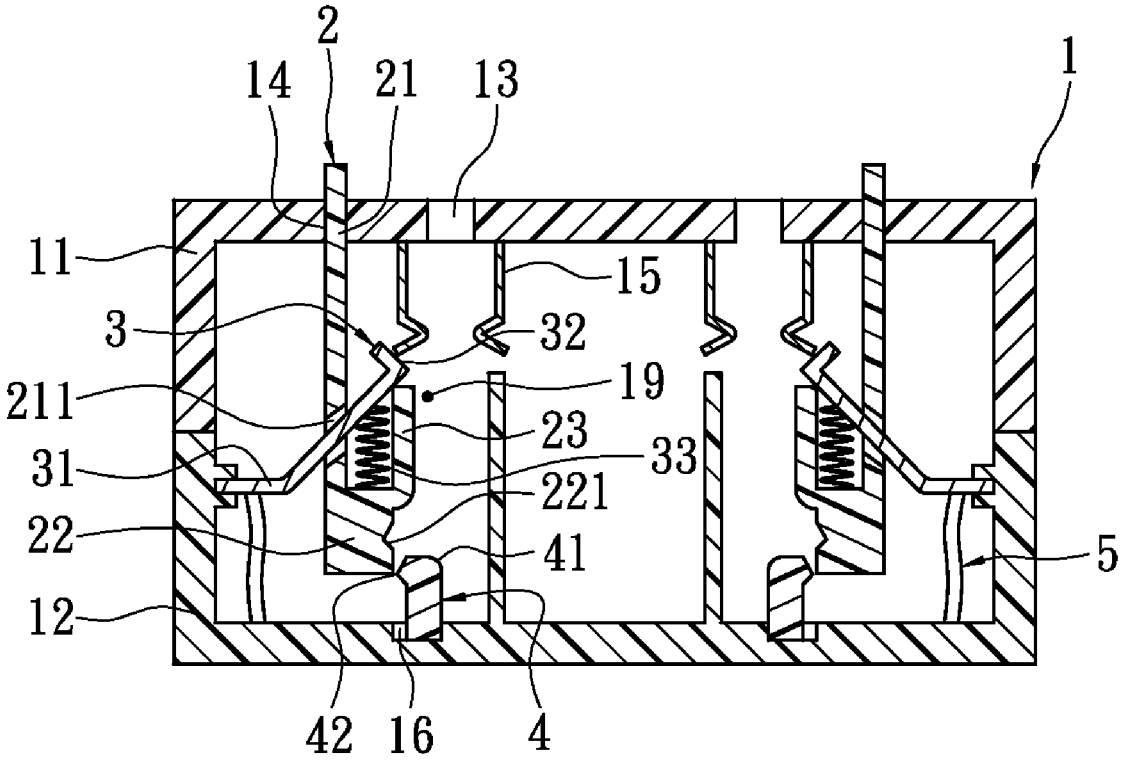
FIG. 5 is a cross-sectional view showing the safety socket structure according to the second embodiment of the present invention.

Please refer to FIG. 5. In the second embodiment of the present invention, an elastic element 33 is provided below the contact piece 3. One end of the elastic element 33 abuts the bottom of the contact piece 3. The other end of the elastic element 33 abuts the top of the engaging body 22 of the control piece 2 or the casing 1, thereby providing a better recovering force for the contact piece 3 to move upwards.

Figure 6:
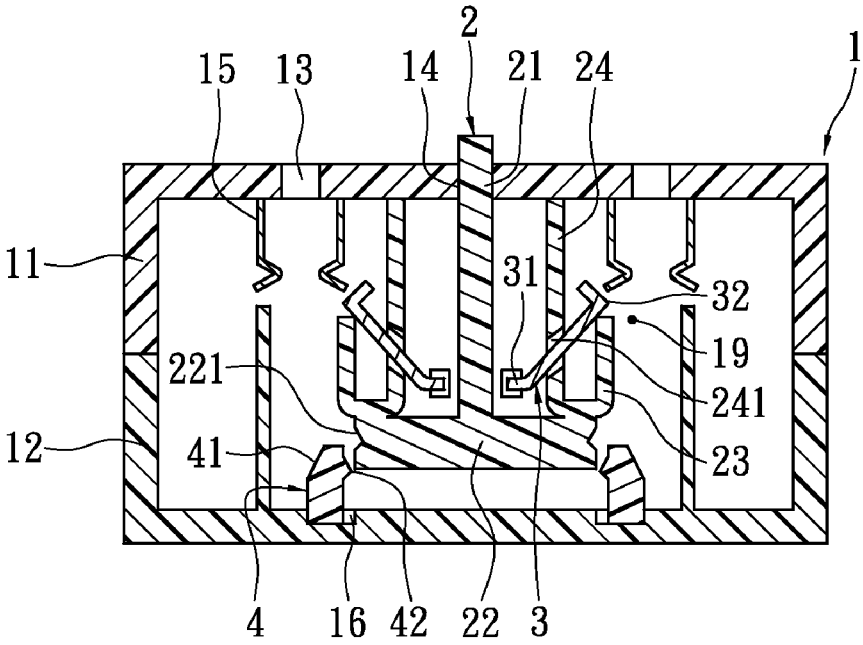
FIG. 6 is a cross-sectional view showing the safety socket structure according to the third embodiment of the present invention.
Figure 7:
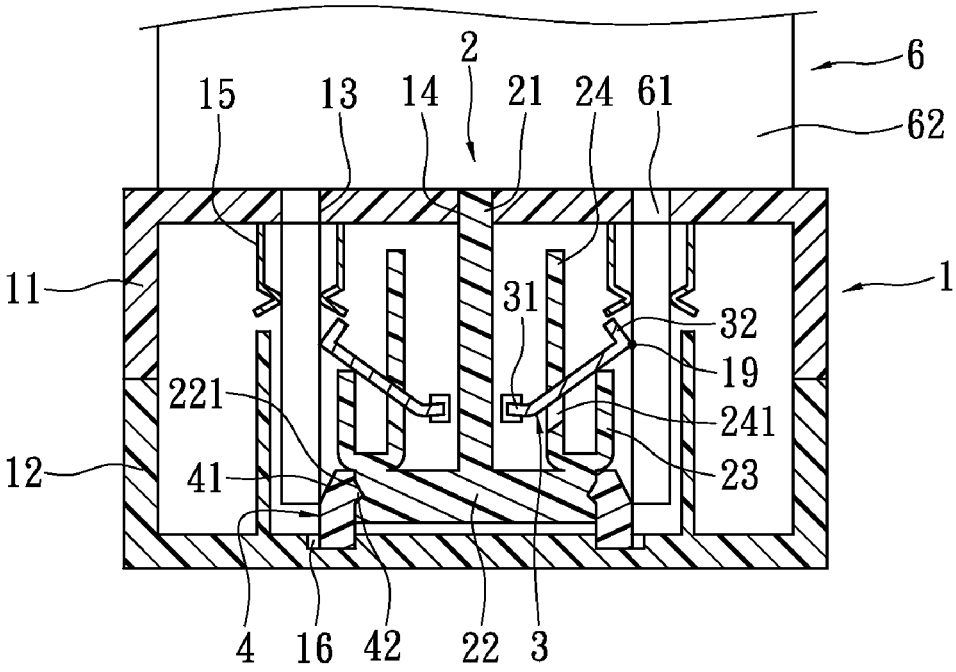
FIG. 7 is a schematic view showing the operating state of the safety socket structure according to the third embodiment of the present invention.

Please refer to FIGS. 6 and 7. In the third embodiment of the present invention, the casing 1 is only provided with a through-hole 14. The through-hole 14 is located between the two insertion holes 13. Further, only one control piece 2 is provided. The control piece 2 has a rod 21, an engaging body 22, and two sub-rods 24. Each of the sub-rods 24 is provided with a penetrating-hole (which can be used as an abutting portion) 241. Both sides of the engaging body 22 are provided with a trough 221 respectively. The top of the engaging body 22 extends to form two stoppers 23. The rod 21 of the control piece 2 is slidably fitted in the corresponding through-hole 14 of the casing 1, so that the control piece 2 can be displaced up ad down. The two contact pieces 3 pass through the penetrating-holes 241 of the corresponding control piece 2. The upper edges of the penetrating-holes 241 of the control piece 2 abut the two contact pieces 3, so that the two contact pieces 3 can swing downwards. The two sliding blocks 4 are located outside the engaging body 22.

In the present embodiment, only one control piece 2 is provided so as to simplify the whole structure. The bottom of the body 62 of the plug 6 pushes the upper end of the rod 21 of the control piece 2, thereby making the control piece 2 to move downwards. Further, the upper edges of the two penetrating-holes 241 of the control piece 2 push the two contact pieces 3, so that the contact ends 32 of the two contact pieces 3 swing downwards to be located in the connecting positions 19 and thereby contacting the two pins 61 of the plug 6. In this way, the two contact pieces 3 are electrically connected to the two pins 61 of the plug 6. The lower ends of the two pins 61 of the plug 6 abut the abutting surfaces 41 of the two sliding blocks 4, so that the two sliding blocks 4 slide toward the engaging body 22 of the control piece 2. The protrusions 42 of the two sliding blocks 4 can be engaged with the troughs 221 on both sides of the engaging body 22 of the control piece 2, thereby fixing the control piece 2.

Figure 8:
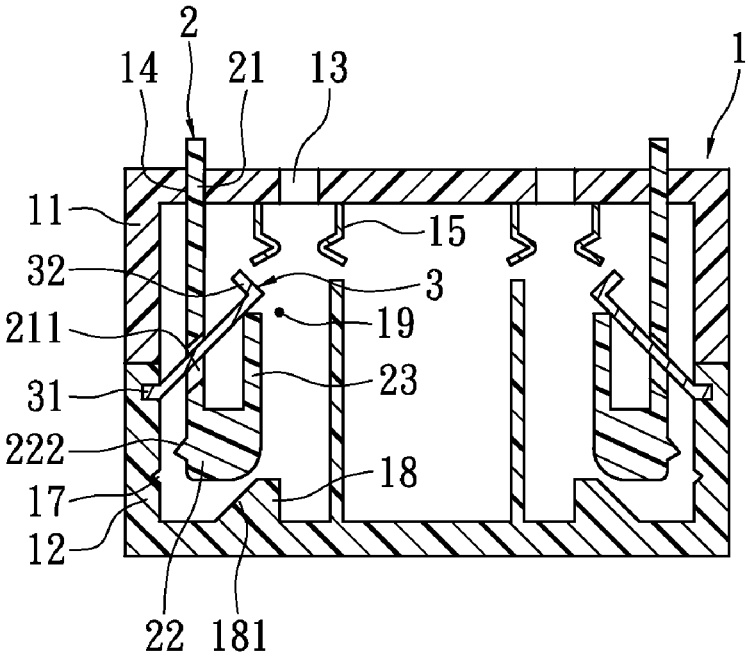
FIG. 8 is a cross-sectional view showing the safety socket structure according to the fourth embodiment of the present invention.
Figure 9:
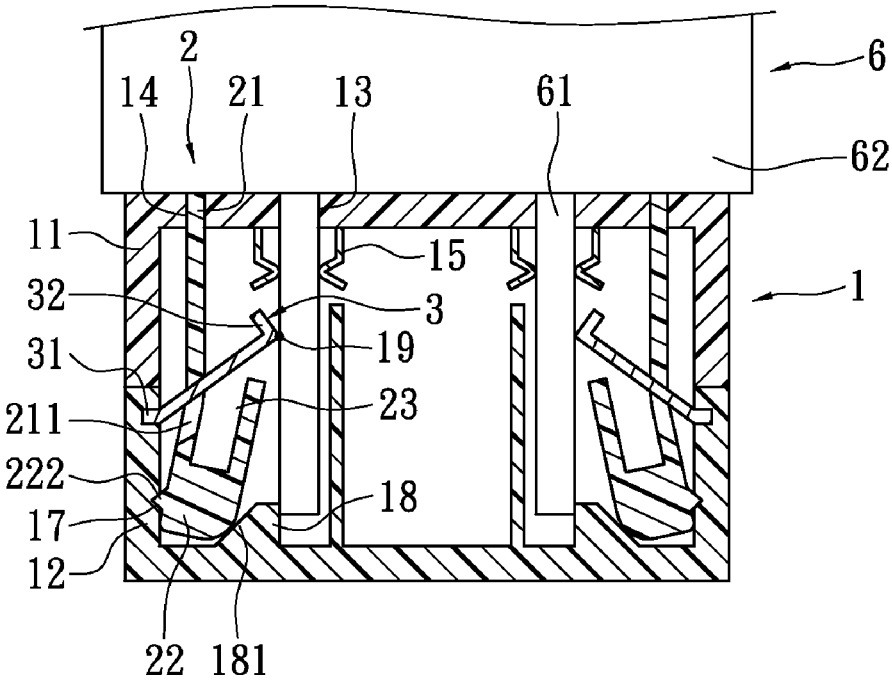
FIG. 9 is a schematic view showing the operating state of the safety socket structure according to the fourth embodiment of the present invention.
Figure 10:
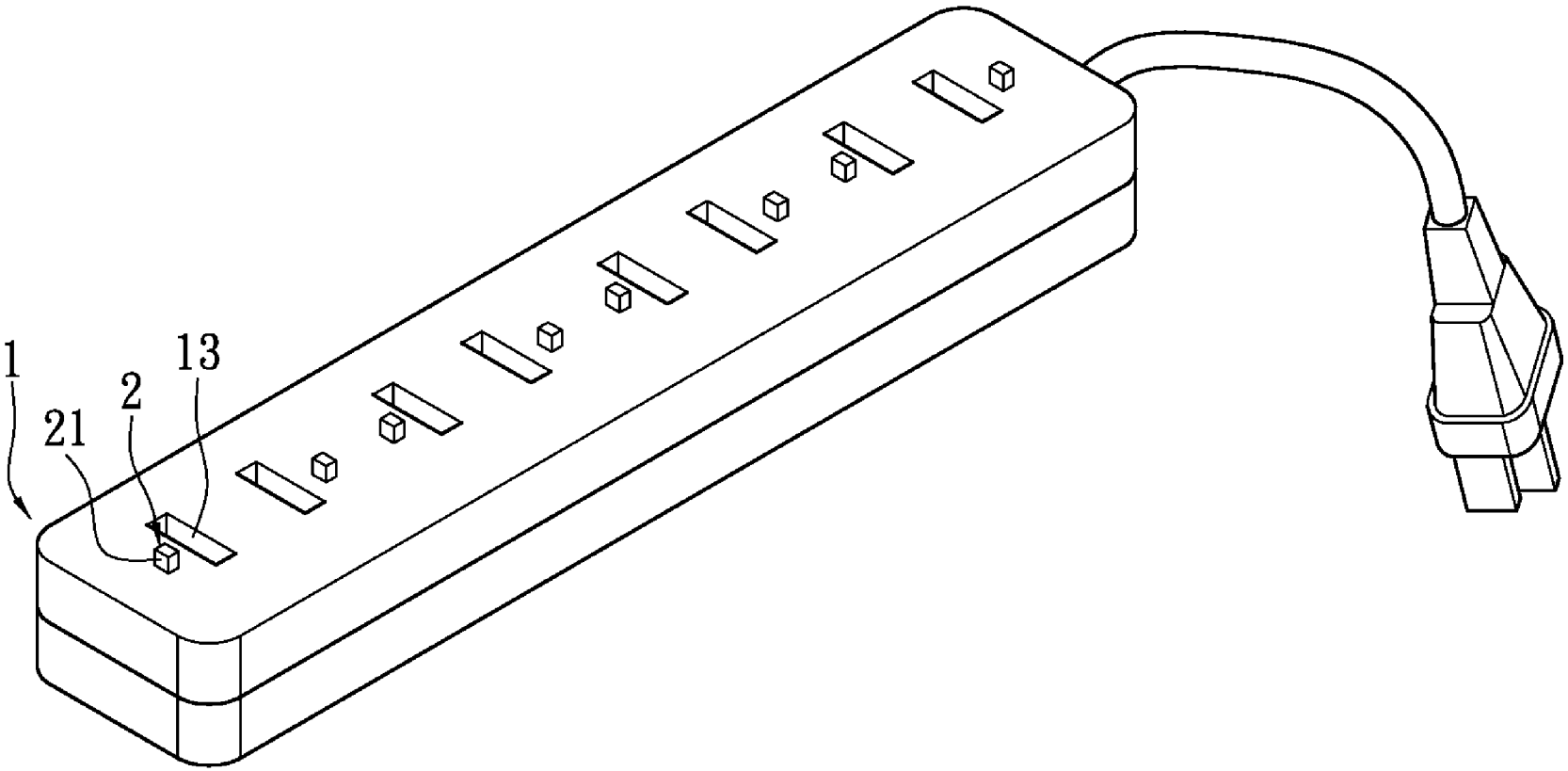
FIG. 10 is a perspective view showing the safety socket structure according to the fifth embodiment of the present invention.
Figure 11:
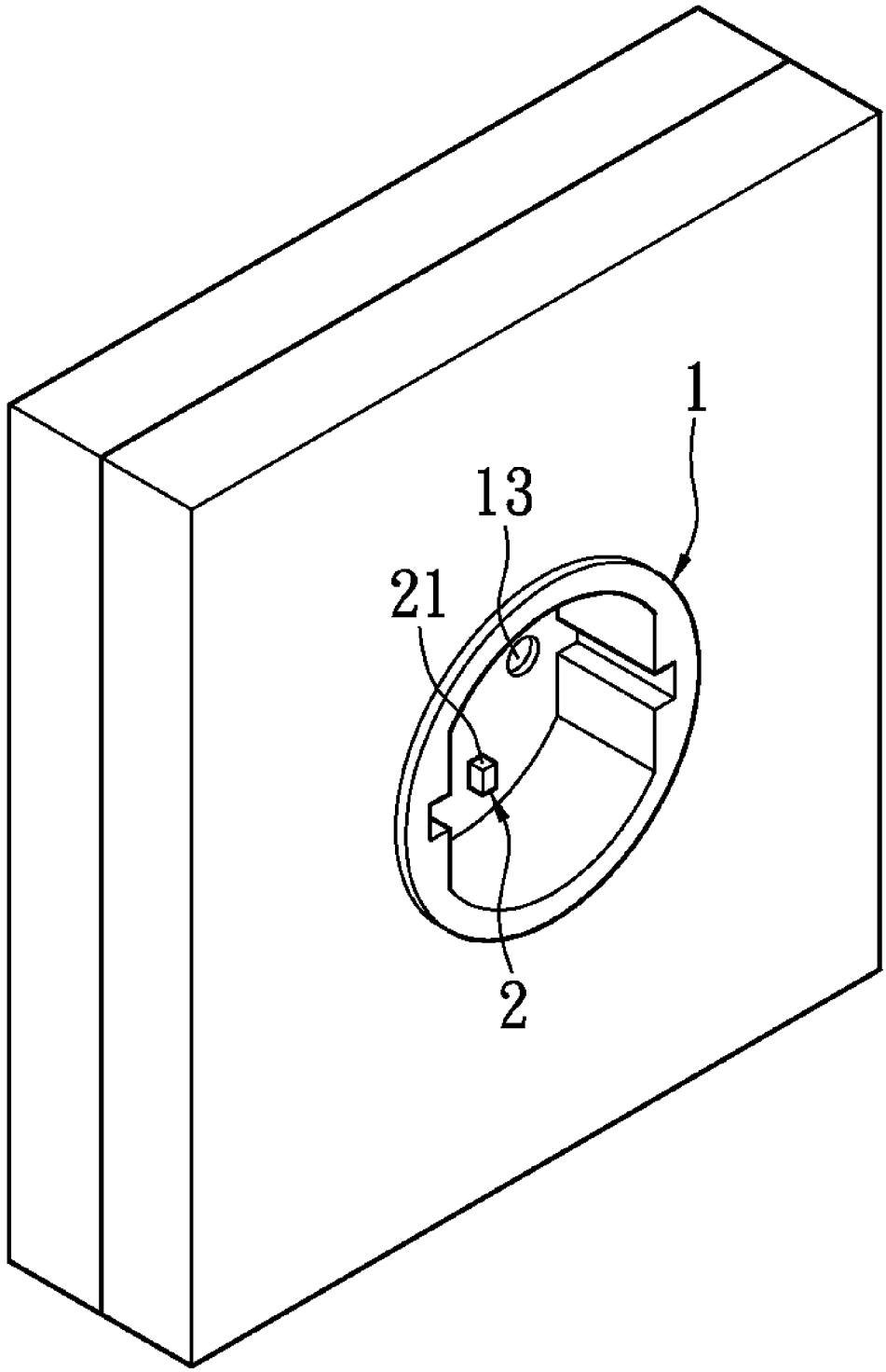
FIG. 11 is a perspective view showing the safety socket structure according to the sixth embodiment of the present invention.
Figure 12:
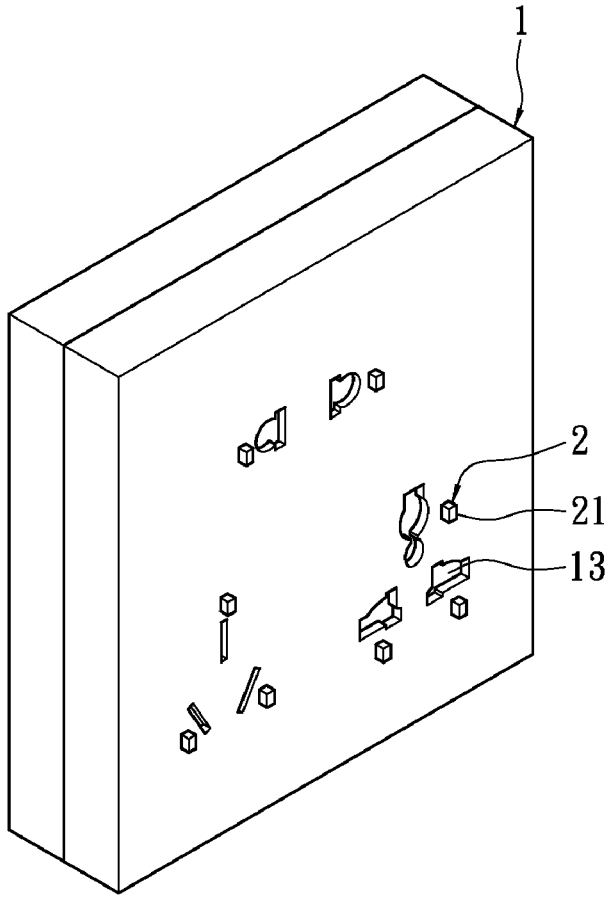
FIG. 12 is a perspective view showing the safety socket structure according to the seventh embodiment of the present invention.
Figure 13:
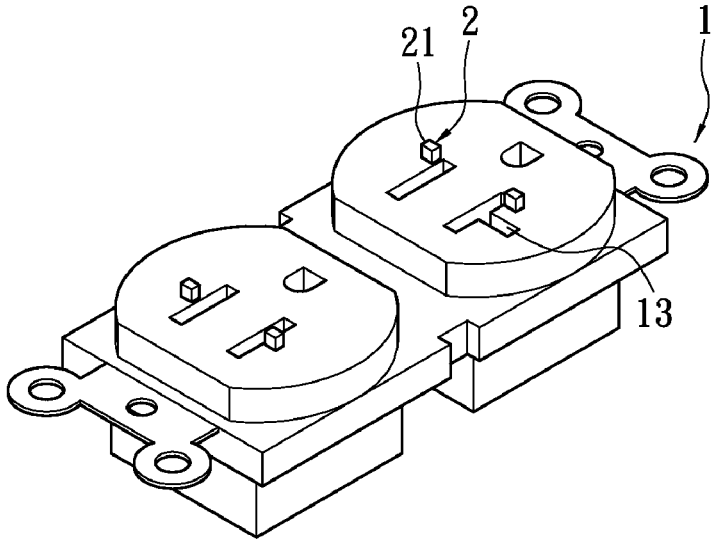
FIG. 13 is a perspective view showing the safety socket structure according to the eighth embodiment of the present invention.

Please refer to FIGS. 8 and 9. In the fourth embodiment of the present invention, one side of each of the engaging bodies 22 of the two control pieces 2 is provided with a protrusion 222 respectively. The interior of the casing 1 is provided with two corresponding troughs 17. The interior of the casing 1 is fixedly provided with two guiding pieces 18 to correspond to the two engaging bodies 22. One side of each guiding piece 18 is formed with an abutting surface 181 that is a slope. When the plug 6 is inserted into the safety socket of the present invention, the bottom of the body 62 of the plug 6 pushes the upper ends of the rods 21 of the two control pieces 2, thereby making the two control pieces 2 to move downwards. The upper edges of the penetrating-holes 211 of the two control pieces 2 push the two contact pieces 3, so that the contact ends 32 of the two contact pieces 3 swing downwards to be located in the connecting positions 19 for contacting the two pins 61 of the plug 6. In this way, the two contact pieces 3 can be electrically connected to the two pins 61 of the plug 6. At the same time, the engaging bodies 22 of the two control pieces 2 abut the abutting surfaces 181 of the two guiding pieces 18, thereby making the engaging bodies 22 of the two control pieces 2 to swing outwards. The protrusions 222 of the two engaging bodies 22 can be engaged with the two corresponding troughs 17 of the casing 1, thereby fixing the two control pieces 2.

Please refer to FIGS. 10 to 13. In the fifth, sixth, seventh, and eighth embodiment of the present invention, various sockets of different types and dimensions are shown.

Figure 14:
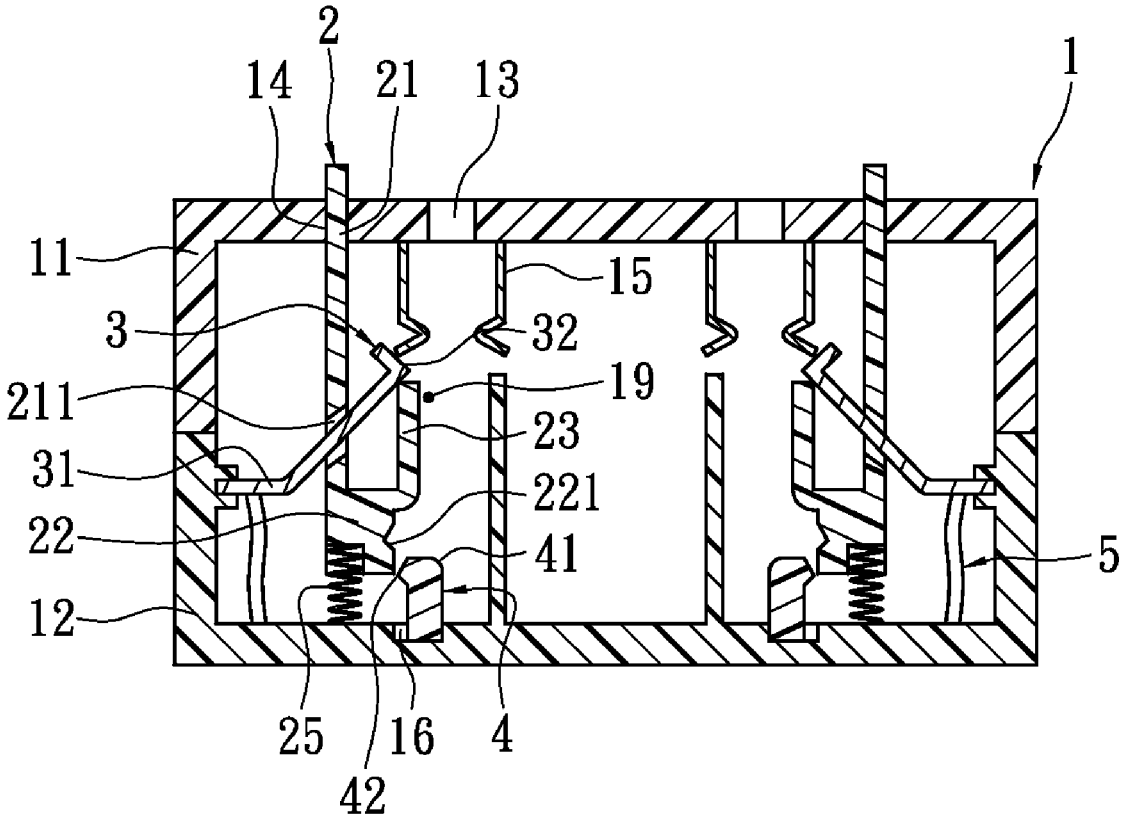
FIG. 14 is a cross-sectional view showing the safety socket structure according to the ninth embodiment of the present invention.

Please refer to FIG. 14. In the ninth embodiment of the present invention, an elastic element 25 is provided below each of the two control pieces 2. One end of the elastic element 25 abuts the casing 1, and the other end of the elastic element 25 abuts the bottom of the engaging body 22 of the control piece 2, thereby providing a better recovering force for the control piece 2 and the contact piece 3 to move upwards.

Figure 15:
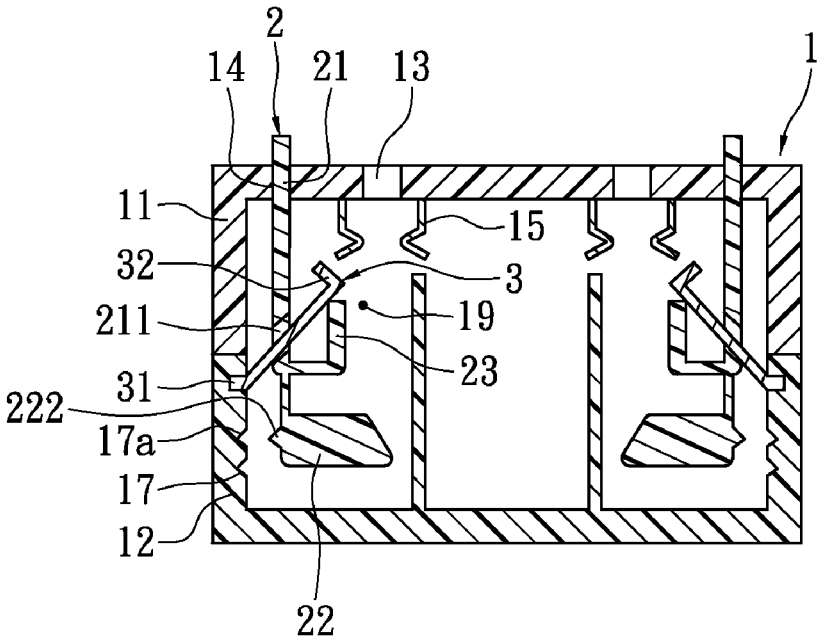
FIG. 15 is a cross-sectional view showing the safety socket structure according to the tenth embodiment of the present invention.
Figure 16:
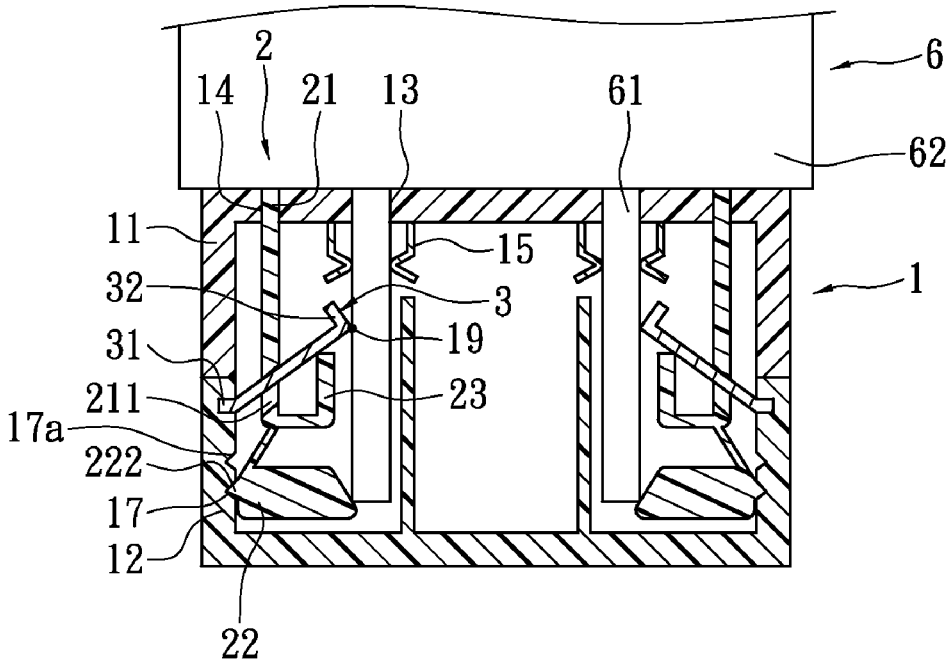
FIG. 16 is a schematic view showing the operating state of the safety socket structure according to the tenth embodiment of the present invention.
Figure 17:
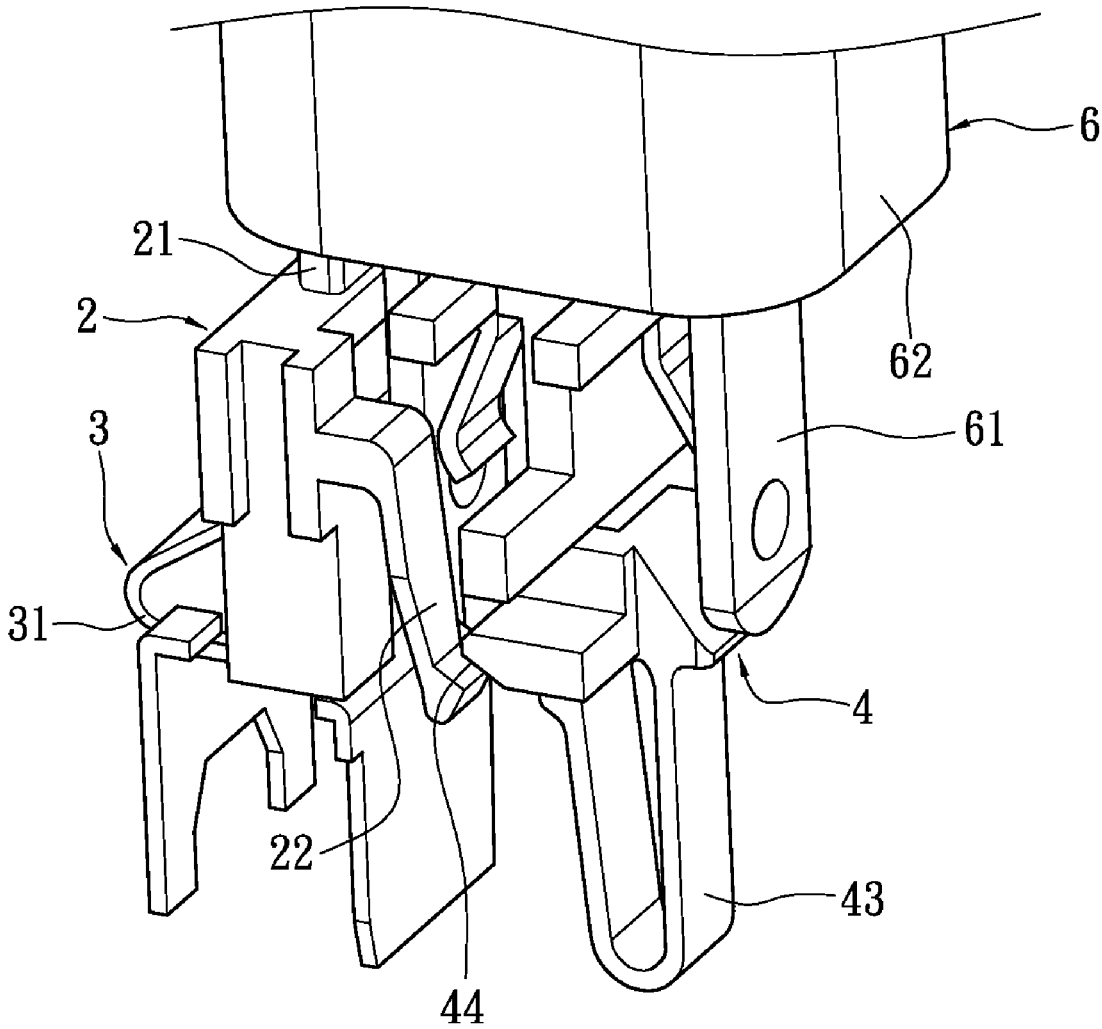
FIG. 17 is a perspective view showing the safety socket structure according to the eleventh embodiment of the present invention.
Figure 18:
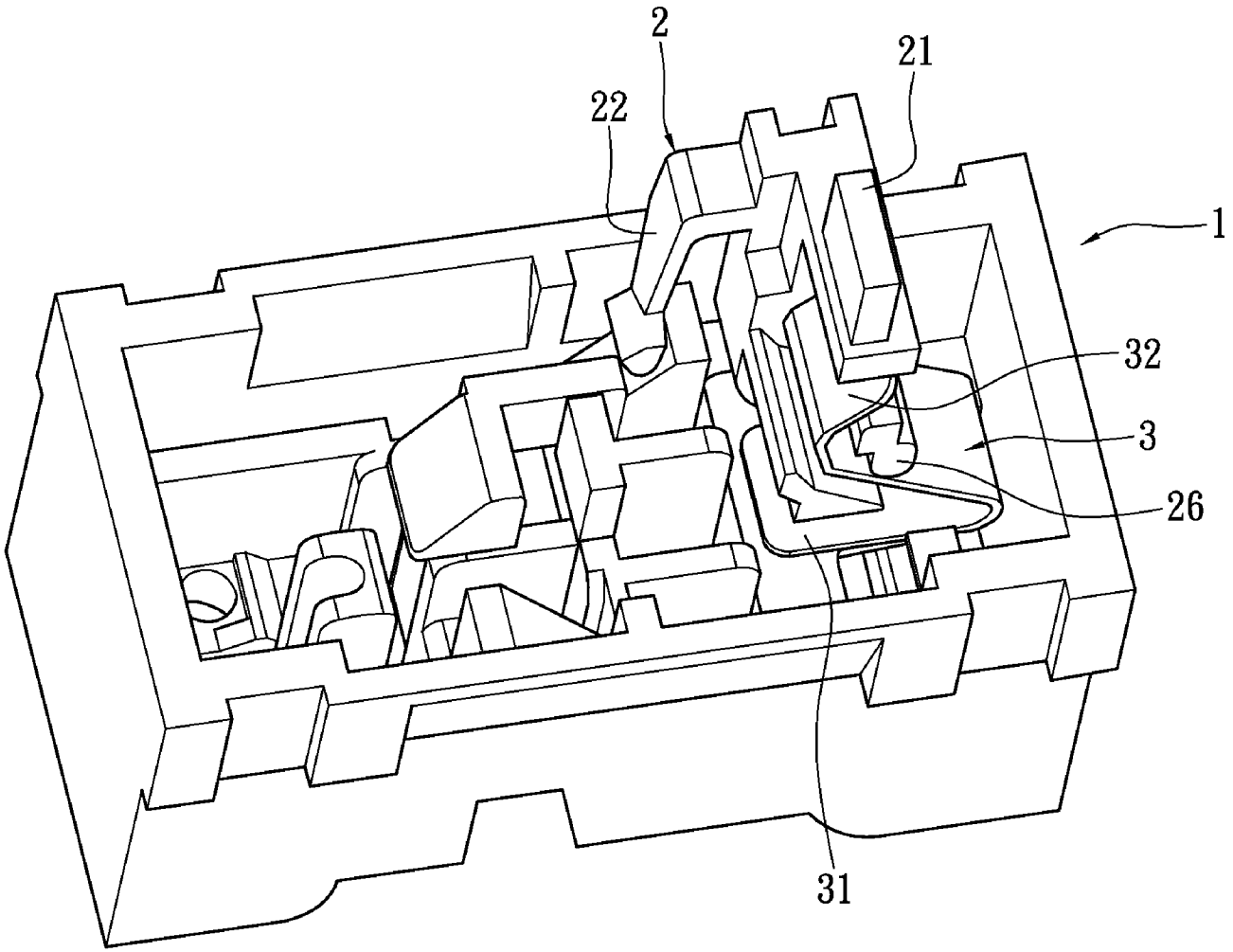
FIG. 18 is an exploded perspective view showing the safety socket structure according to the eleventh embodiment of the present invention.

Please refer to FIGS. 15 and 16. In the tenth embodiment of the present invention, one side of the engaging bodies 22 of the two control pieces 2 are provided with a protrusion 222 respectively. The interior of the casing 1 is provided with two troughs 17 and two upper troughs 17*a* correspondingly. If a child inserts a metallic rod when the plug 6 is not inserted into the safety socket of the present invention, the metallic rod will push the engaging body 22 of the control piece 2 to swing outwards, so that the protrusion 222 of the engaging body 22 can be engaged with the corresponding upper trough 17*a* of the casing 1. Thus, the control piece 2 will not be pushed or moved easily.

When the plug 6 is inserted into the safety socket of the present invention, the bottom of the body 62 of the plug 6 pushes the upper ends of the rods 21 of the two control pieces 2, thereby making the two control pieces 2 to move downwards. The upper edges of the penetrating-holes 211 of the two control pieces 2 push the two contact pieces 3, so that the contact ends 32 of the two contact pieces 3 swing downwards to be located in the connecting positions 19, thereby contacting the two pins 61 of the plug 6. In this way, the two contact pieces 3 are electrically connected to the two pins 61 of the plug 6. At the same time, the engaging bodies 22 of the two control pieces 2 are pushed by the two pins 61 of the plug 6, thereby making the engaging bodies 22 of the two control pieces 2 to swing outwards. The protrusions 222 of the two engaging bodies 22 can be engaged with the two corresponding troughs 17 of the casing 1, thereby securing the two control pieces 2.

Please refer to FIGS. 17 to 20. In the eleventh embodiment of the present invention, two control pieces 2 can be liftably provided in the casing 1. Each of the control pieces 2 has a rod 21 and an abutting portion 26. The abutting portion 26 is a transverse rod that is located above the contact piece 3. Only one of the control pieces 2 is provided with an engaging body 22. The engaging body 22 is formed by means of extending downwards from one side of the control piece 2. The engaging body 22 is an elastic hook with its lower end abutting a guiding slope 27. The guiding slope 27 is fixed in the casing 1. In the present embodiment, only one sliding block 4 is provided. The sliding block 4 is provided in the casing 1 and supported by an elastic arm 43. The sliding block 4 is located on one side of the engaging body 22. The sliding block 4 can slide toward (or away from) the engaging body 22 of the control piece 2. One side of the sliding block 4 is formed with an abutting surface 41 that is a slope. The other side of the sliding block 4 that is opposite to the abutting surface 41 is provided with a recess 44 corresponding to the engaging body 22. When the sliding block 4 moves toward the engaging body 22 of the control piece 2, the recess 44 of the sliding block 4 can be engaged with the engaging body 22 of the control piece 2.

Figure 19:
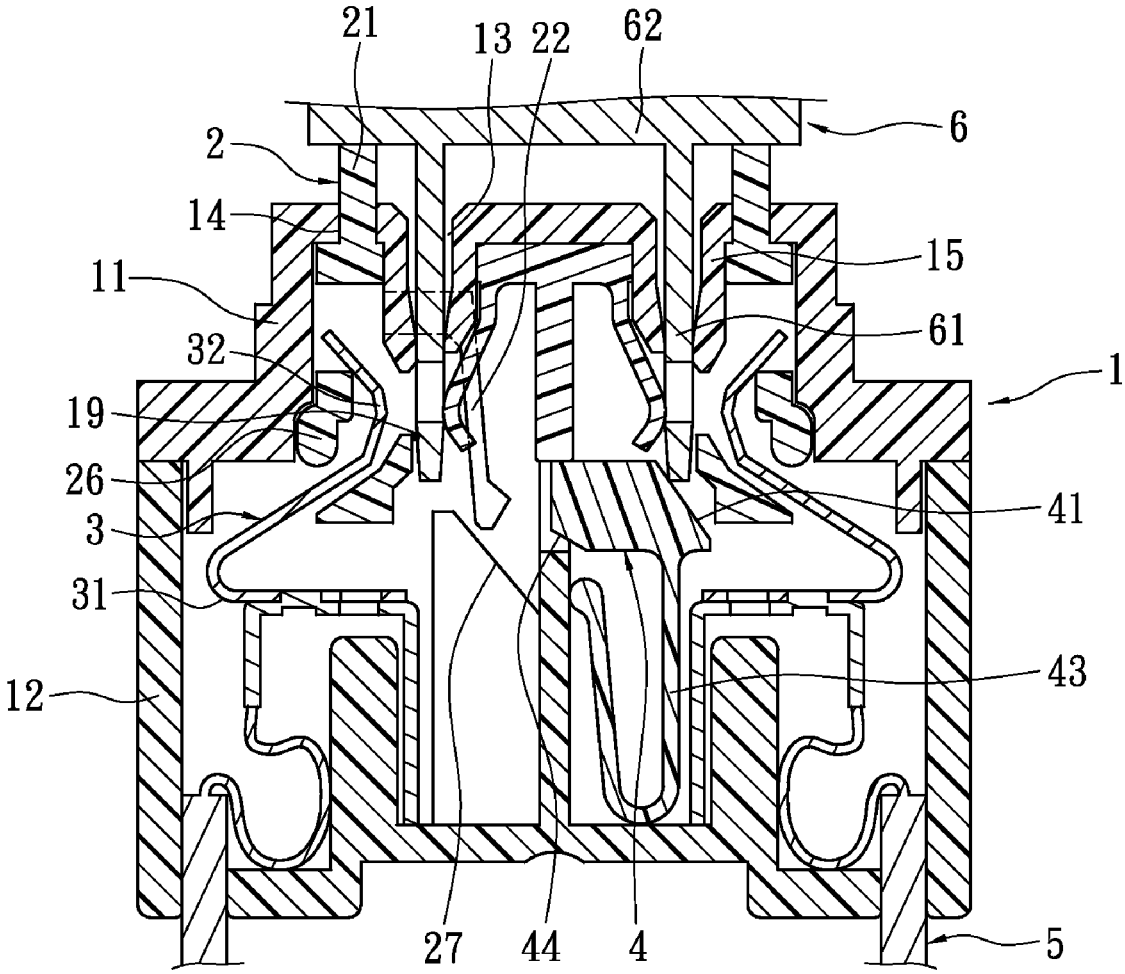
FIG. 19 is a cross-sectional view showing the safety socket structure according to the eleventh embodiment of the present invention.
Figure 20:
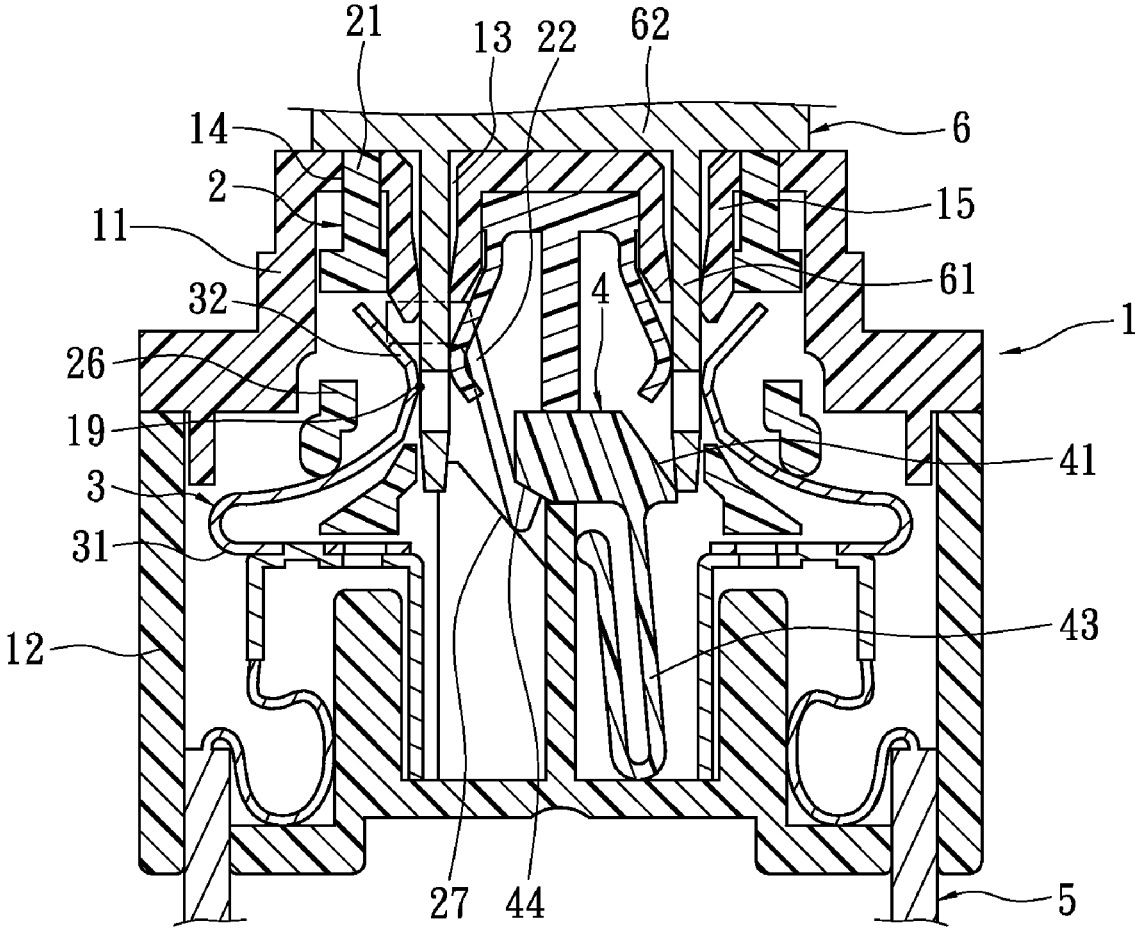
FIG. 20 is a schematic view showing the operating state of the safety socket structure according to the eleventh embodiment of the present invention.

Please refer to FIGS. 19 and 20. When the plug 6 is inserted into the safety socket of the present invention, the two pins 61 of the plug 6 are inserted into the casing 1 through the two insertion holes 13 of the casing 1 simultaneously. The bottom of the body 62 of the plug 6 pushes the upper ends of the rods 21 of the two control pieces 2, thereby making the two control pieces 2 to move downwards. The abutting portions 26 of the two control pieces 2 abut the two contact pieces 3, so that the contact ends 32 of the two contact pieces 3 swing downwards to be located in the connecting positions 19, thereby contacting the two pins 61 of the plug 6. In this way, the two contact pieces 3 are electrically connected to the two pins 61 of the plug 6. At the same time, the lower end of one pin 61 of the plug 6 abuts the abutting surface 41 of the sliding block 4, so that the sliding block 4 moves toward the engaging body 22 of the control piece 2. The engaging body 22 is guided by the guiding slope 27 to move toward the sliding block 4. The recess 44 of the sliding block 4 can be engaged with the engaging body 22 of the control piece 2, thereby fixing the two control pieces 2.

While the present invention has been described in terms of what is presently considered to be the most practical and preferred embodiments, it is to be understood that the present invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A safety socket structure, comprising:

a casing provided with two insertion holes and two through-holes, the interior of the casing being formed with connecting positions corresponding to the insertion holes;

two control pieces liftably provided in the casing, the two control pieces protruding through the two through-holes to the outside of the casing; and two contact pieces provided in the casing, the two control pieces abutting the two contact pieces with the two contact pieces extending into the connecting positions selectively.

2. The safety socket structure according to claim 1, characterized in that each of the insertion holes is provided with two clippers, and the two clippers are formed by extending from the casing.

3. The safety socket structure according to claim 1, characterized in that each of the two control pieces has a rod, the rod is provided with an abutting portion, the rods of the two control pieces are slidably fitted in the corresponding through-holes of the casing, the abutting portions of the two control pieces abut the two contact pieces.

4. The safety socket structure according to claim 3, characterized in that the abutting portion is a penetrating-hole, the two contact pieces pass through the penetrating-holes of the two control pieces, and the upper edges of the penetrating-holes of the two control pieces abut the two contact pieces.

5. The safety socket structure according to claim 1, characterized in that each of the two control pieces has a stopper.

6. The safety socket structure according to claim 1, characterized in that each of the two control pieces has an engaging body for engaging the control piece when the two control pieces move downwards.

7. The safety socket structure according to claim 6, characterized in that the engaging bodies of the two control pieces are provided with a trough respectively, the interior of the casing is slidably provided with two sliding blocks, each of the two sliding blocks is formed with a protrusion, the protrusions of the two sliding blocks are engaged with the troughs of the engaging bodies of the two control pieces when the two sliding blocks move toward the engaging bodies of the two control pieces.

8. The safety socket structure according to claim 6, characterized in that one side of each of the engaging bodies of the two control pieces is provided with a protrusion respectively, the interior of the casing is provided with at least two troughs, the interior of the casing is provided with two guiding pieces corresponding to the two engaging bodies, the engaging bodies of the two control pieces abut the two guiding pieces selectively, so that the protrusions of the engaging bodies of the two control pieces are engaged with the troughs of the casing.

9. The safety socket structure according to claim 6, characterized in that one side of the engaging bodies of the two control pieces are provided with a protrusion respectively, the interior of the casing is provided with at least two troughs, the protrusions of the engaging bodies of the two control pieces are engaged with the troughs of the casing.

10. The safety socket structure according to claim 1, characterized in that one end of each of the two contact pieces is formed with a fixed end respectively, the fixed ends of the two contact pieces are fixed to the casing, the other end of each of the two contact pieces is formed with a contact end respectively, the two contact pieces are electrically connected to a power line respectively.

11. The safety socket structure according to claim 1, characterized in that an elastic element is provided below each of the two contact pieces, the two elastic elements abut the bottom of the two contact pieces.

12. The safety socket structure according to claim 1, characterized in that an elastic element is provided below each of the two control pieces, the two elastic elements abut the bottom of the two control pieces.

13. The safety socket structure according to claim 1, characterized in that one of the two control pieces has an engaging body, the engaging body is engaged with the control piece when the control piece moves downwards.

14. The safety socket structure according to claim 13, characterized in that the interior of the casing is provided with a sliding block, the sliding block is formed with a recess, and the recess of the sliding block is engaged with the engaging body of the control piece when the sliding block moves toward the engaging body of the control piece.

15. The safety socket structure according to claim 14, characterized in that the sliding block is provided in the casing and supported by an elastic arm.

16. A safety socket structure, comprising:

a casing provided with two insertion holes and a through-hole, the interior of the casing being formed with connecting positions corresponding to the insertion holes;

a control piece liftably provided in the casing, the control piece protruding through the through-hole to the outside of the casing; and two contact pieces provided in the casing, the control piece abutting the two contact pieces with the two contact pieces extending into the connecting positions selectively;

the control piece has an engaging body for engaging the control piece when the control piece moves downwards;

the engaging body of the control piece is provided with two troughs, the interior of the casing is slidably provided with two sliding blocks, each of the two sliding blocks is formed with a protrusion, and the protrusions of the two sliding blocks are engaged with the two troughs of the engaging body of the control piece when the two sliding blocks move toward the engaging body of the control piece.

17. The safety socket structure according to claim 16, characterized in that the control piece has a rod and two sub-rods, each of the two sub-rods is provided with an abutting portion, the rod of the control piece is slidably fitted in the corresponding through-hole of the casing, the two abutting portions of the control piece abut the two contact pieces.

18. The safety socket structure according to claim 17, characterized in that the abutting portion is a penetrating-hole, the two contact pieces pass through the two penetrating-holes of the control piece, and the upper edges of the two penetrating-holes of the control piece abut the two contact pieces.

19. The safety socket structure according to claim 16, characterized in that the control piece has two stoppers.

20. A safety socket structure, comprising:

a casing provided with insertion holes and through-holes, the interior of the casing being formed with connecting positions corresponding to the insertion holes;

control pieces liftably provided in the casing, the control pieces protruding through the through-holes to the outside of the casing; and contact pieces provided in the casing, the control pieces abutting the contact pieces with the contact pieces extending into the connecting positions selectively.

* * * * *